US005205314A

United States Patent [19]

Moore

[11] Patent Number: 5,205,314

[45] Date of Patent: Apr. 27, 1993

[54] AIR COMPRESSOR CONDENSATE REMOVAL SYSTEM

[75] Inventor: Odis A. Moore, Odessa, Tex.

[73] Assignee: James A. Kyer, Odessa, Tex.

[21] Appl. No.: 883,953

[22] Filed: May 15, 1992

[51] Int. Cl.[5] ..... B01D 47/00

[52] U.S. Cl. ..... 137/203; 137/204

[58] Field of Search ..... 137/203, 171, 204

[56] References Cited

U.S. PATENT DOCUMENTS

| | | | |
|---|---|---|---|
| 825,796 | 7/1906 | Barlett et al. . | |
| 1,828,626 | 10/1931 | Swendeman . | |
| 3,091,097 | 5/1963 | Friant . | |
| 3,916,936 | 11/1975 | Villaume | 137/204 |
| 4,038,051 | 7/1977 | Ide | 137/204 X |
| 4,052,178 | 10/1977 | Frantz | 137/204 X |
| 4,409,005 | 10/1983 | McKendrick . | |
| 4,867,151 | 9/1989 | Bird . | |

*Primary Examiner*—Alan Cohan

*Attorney, Agent, or Firm*—Richard C. Litman

[57] ABSTRACT

An expansion chamber is attached between two air compression stages of an air compressor or between an air compression stage and the air holding tank of the air compressor. The expansion chamber has a cylindrically shaped wall with top and bottom portions attached so as to define an enclosed inner chamber. The enclosed inner chamber may have one or more baffle plates located therein. Various designs of baffle plate arrangements provide different air circulating patterns within the expansion chamber. Since the expansion chamber is exposed to the ambient environment, the compressed air heated in the compression process is cooled down in the expansion chamber. This cooling down of the compressed air as well as the expansion of the compressed air as it circulates within the enclosed inner chamber causes any moisture suspended in the compressed air to drop out and go to the bottom of the expansion chamber. Black pipe arrangements are provided to supply the compressed air to as well as bleed the compressed air from the expansion chamber. In this way the compressed air is thermally isolated from the ambient temperature except in the expansion chamber.

5 Claims, 5 Drawing Sheets

AIR COMPRESSOR CONDENSATE REMOVAL SYSTEM

BACKGROUND OF THE INVENTION

1. Field of the Invention

This invention relates to devices designed to remove unwanted condensate formed in air compressor systems. More specifically, this invention relates to devices using expansion chambers with a plurality of baffle chambers located therein, wherein an inlet leading into a first baffle chamber is connected to a discharge stage of an air compressor through the use of a black pipe arrangement and an outlet is used to bleed off a last baffle chamber for discharging compressed air free of condensate through the use of another black pipe arrangement.

2. Description of the Prior Art

U.S. Pat. No. 825,796 issued Jul. 10, 1906 to John H. Barlett et. al. and U.S. Pat. No. 1,828,626 issued Oct. 20, 1931 to Joseph E. Swendeman both disclose various designs for expansion chambers.

U.S. Pat. No. 3,091,097 issued May 28, 1963 to David R. Friant discloses a system which uses condensate traps between compression stages.

U.S. Pat. No. 4,409,005 issued Oct. 11, 1983 to Lorne J. McKendrick discloses the use of a filter for removing condensate from air.

U.S. Pat. No. 4,867,151 issued Sep. 19, 1989 to Forrest M. Bird discloses using the heat of the compressor motor to remove condensate from an air compressor holding tank.

None of the prior art of record discloses the use of black pipes leading to and from an expansion chamber having the baffle chamber designs of the present invention to remove condensate from air passed therethrough.

SUMMARY OF THE INVENTION

Therefore, one object of the present invention is to use baffle plates positioned in the expansion chamber to eliminate moisture from the air in a first baffle chamber of the expansion chamber.

Another object of the present invention is to use black pipes leading to the inlet of the expansion chamber and from the outlet of the expansion chamber, in order to thermally isolate the air going to and coming from the expansion chamber.

These and other objects of the present invention will become evident with further inquiry into the following specification and drawings.

Most conventional air compressors use intercoolers between compression stages. Each intercooler cools the compressed air from one compression chamber stage before passing the compressed air to another compression stage or air holding tank (e.g., see U.S. Pat. No. 3,091,097 issued on May 28, 1963 to David R. Friant and made of record). Any moisture within the air passed through the intercooler would condense into water due to the drop in temperature. This water is then passed on to the next stage. If the next stage is another compression stage, this water then can cause rust or can mix with the oil thereby reducing the lubricant qualities of the oil causing internal parts to wear out faster. If the last stage is the air holding tank, then the water enters therein causing the tank to rust and can cause damage to valuable equipment by passing the water to any air tools or the like connected to the air tank.

A first embodiment of the present invention addresses these problems by providing conventional black pipes to receive and pass compressed air from and to an expansion chamber connected between two compression chamber stages. The black pipes thermally insulate the compressed air passing therethrough so that the compressed air does not drop in temperature before reaching the expansion chamber or after leaving the expansion chamber. In this way moisture drops out of the air in the expansion chamber only due to a drop in temperature within the expansion chamber as well as the expansion of the compressed air within the expansion chamber as the air circulates therein. The black pipe arrangements used in the first embodiment of the present invention thereby prevent moisture from dropping out of the air anywhere except in the expansion chamber as well as prevent any moisture within the black pipes from freezing, thereby preventing the clogging of the air passageway between air compression stages.

DETAILED DESCRIPTION OF THE PREFERRED EMBODIMENTS

Figure 1:
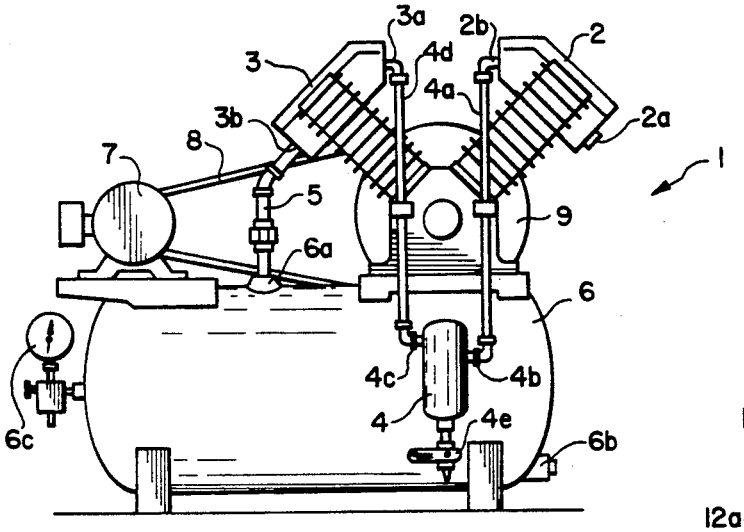
FIG. 1 is a front elevational view of the present invention where the compressor is a dual piston compressor.

In FIG. 1 there is shown one environment in which the device of the present invention may be used. In this environment the air compressor condensate removal system is used between two compression chamber stages of an air compressor 1. A first compression chamber stage 2 has an air inlet **2*a* for allowing air from the ambient environment to enter into the compression chamber. The compressed air from this stage then exits through an outlet 2*b* connected to one end of a black pipe arrangement 4*a*. The other end of the black pipe arrangement 4*a* is connected to the inlet 4*b* of an expansion chamber 4. The compressed air exiting the end of the black pipe arrangement 4*a* connected to the inlet 4*b*, enters the expansion chamber 4 where any moisture suspended in the air drops out to the bottom of the expansion chamber 4**. A manually operated drain valve 4e is provided at the bottom of the expansion chamber 4 for allowing the user to periodically purge the expansion chamber of the water which collects at the bottom. The moisture-free compressed air circulating within the expansion chamber 4 exits therefrom through the outlet 4c connected to one end of the black pipe arrangement 4d. This air then exits the other end of the black pipe arrangement 4d and enters the second compression chamber stage 3 through the inlet 3a. The air is then compressed further and enters one end of the pipe arrangement 5 connected to the outlet 3b of the air compression chamber 3. The air then exits the pipe arrangement 5 from the other end connected to the inlet 6a where the moisture-free compressed air is then stored in an air holding tank 6. The air holding tank has an outlet 6b connectable to air hoses used for operating air tools or the like. The air holding tank 6 also conventionally has a pressure gauge 6c for indicating to a user the pressure of the air within the air holding tank 6. The conventional air compressor 1 also has a motor 7 for driving a belt 8 connected to a flywheel 9. The motion of the flywheel 9 operates each piston (not shown) within the air compression chambers 2 and 3 in the conventional manner.

Figure 2:
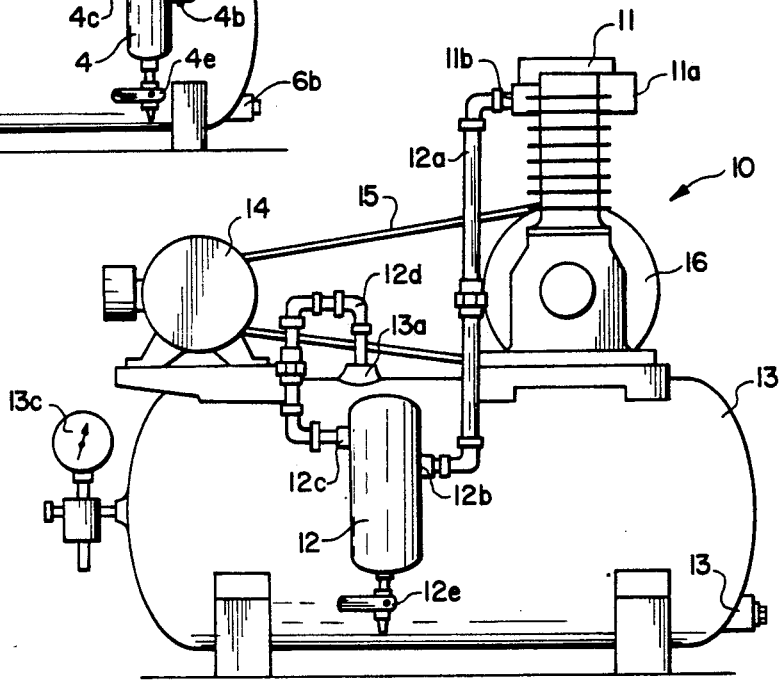
FIG. 2 is a front elevational view of the present invention where the compressor is a single piston compressor.

As shown in FIG. 2, another environment is illustrated in which the condensate removal system is attached between the outlet 11b of the single air compression chamber 11 and the inlet 13a to the air holding tank 13. Since there is only one air compression chamber 11 used in air compressor 10, the expansion chamber 12 passes the moisture-free compressed air to the air holding tank 13. More specifically, air from the ambient environment enters the air compression chamber 11 through an inlet 11a. The compressed air then exits the compression chamber 11 via outlet 11b connected to a black pipe arrangement 12a which passes the compressed air to an inlet 12b of the expansion chamber 12. The compressed air, along with any moisture suspended therein, enters the expansion chamber 12. Any moisture within the compressed air entering the expansion chamber drops out of the air and settles to the bottom of the expansion chamber 12. A drain valve 12e is provided at the bottom of the expansion chamber 12 to allow the user to periodically purge the water which settles at the bottom of the expansion chamber 12. The moisture-free air circulating within the expansion chamber 12 exits through outlet 12c connected to black pipe arrangement 12d. This air passes through black pipe arrangement 12d to enter the air holding tank 13 via inlet 13a. Air holding tank 13 has an outlet 13b connectable to an air hose for operating air tools or the like. The air holding tank 13 also has a pressure gauge 13c for indicating to a user the pressure of the air within the air holding tank 13. A motor 14 is used to drive a flywheel 16 connected to the motor by a belt 15. The motion imparted to the flywheel 16 moves the piston (not shown) within the compression chamber 11 in the conventional manner.

Figure 3:
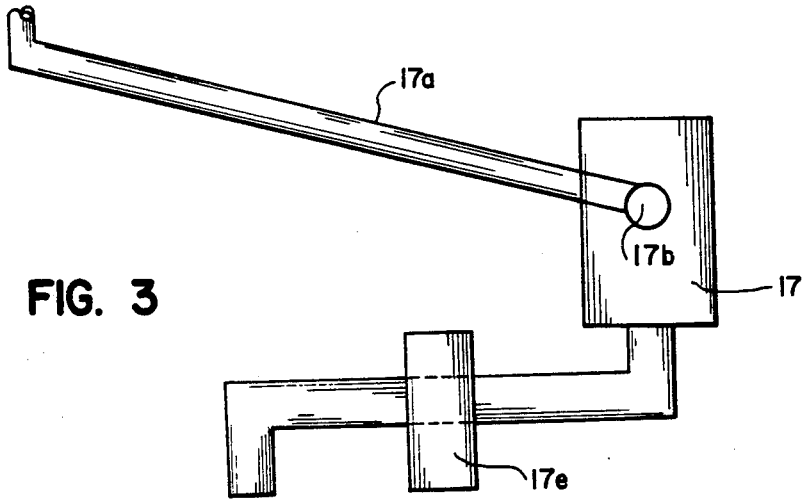
FIG. 3 is a partial side view of the present invention using an automatic drain valve.

As shown in FIG. 3, an automatic drain valve 17e could be used as a substitute for the manually operated drain valves of the first or second embodiments. The expansion chamber 17 is connected in the same manner to an air compressor as disclosed in the first or second embodiments above. A black pipe arrangement 17a is used to receive the compressed air from a compression chamber (not shown). This air is then passed to the expansion chamber 17 where any moisture suspended in the air drops out to the bottom of the compression chamber. An automatic drain valve 17e is a solenoid operated drain valve activated each time the compressor is turned off. The automatic drain valve 17e is preferably the skinner electric solenoid valve automatic drain system.

Figure 4:
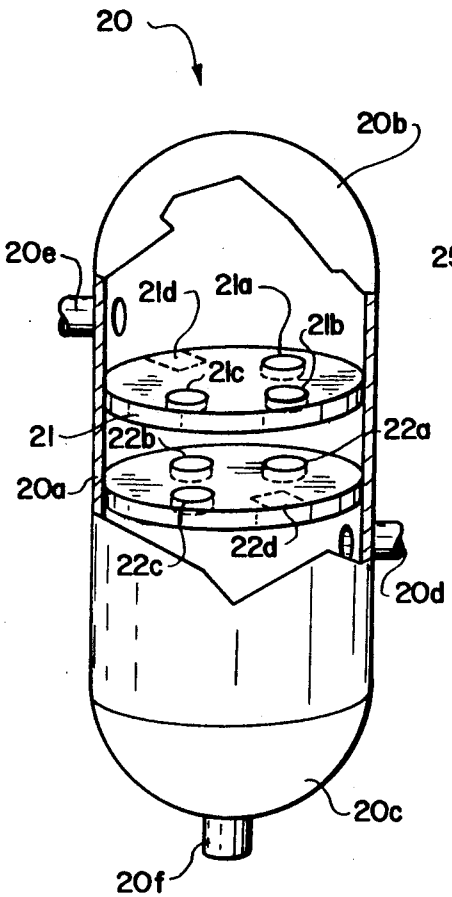
FIG. 4 is a first embodiment of the present invention.

FIG. 4 illustrates one embodiment of the present invention in which an expansion chamber 20 has a cylindrically shaped wall 20a with a top semi-spherical hollow portion 20b and a bottom semi-spherical hollow portion 20c attached thereto. The expansion chamber 20 has an air inlet 20d and an air outlet 20e, which are connectable to black pipe arrangements as discussed in the two environments described above. The expansion chamber 20 also has a drain outlet 20f for placing thereon either the manual drain valve or the automatic drain valve as discussed above.

Within the expansion chamber 20 are a top circular baffle plate 21 and a bottom circular baffle plate 22. The top circular baffle plate 21 is located below the air outlet 20e and the bottom circular baffle plate 22 is located above the air inlet 20d. In this way compressed air enters a bottom baffle chamber of the expansion chamber through the air inlet 20d. Holes in the bottom circular baffle plate 22 allow the compressed air to exit the bottom baffle chamber and enter a middle baffle chamber between the top circular baffle plate 21 and the bottom circular baffle plate 22. Holes in the top circular baffle plate 21 allow the compressed air to then pass to the top baffle chamber where the air outlet 20e passes the compressed air to the next compression stage or the holding air tank as discussed above.

The holes in the top circular baffle plate 21 are three circular cutouts 21a, 21b, and 21c which are equally spaced from each other in an equilateral triangular fashion, i.e. the distances from the center of each circular cutout to the centers of each of the other two circular cutouts are the same. The holes in the bottom circular baffle plate 22 are three circular cutouts 22a, 22b, and 22c, which are also equally spaced from each other in the same fashion as the three circular cutouts 21a, 21b, and 21c. The circular cutouts 22a, 22b, and 22c are not located directly above the circular cutouts 21a, 21b, 21c. Optional square notches 21d and 22d may be provided on the circular baffle plates 21 and 22, respectively. These square notches would be located on the outer perimeter of their respective circular baffle plates, such that squate notch 21d is located directly above a region of the bottom circular baffle plate 22 which is directly opposite a region of the circular baffle plate 22 the square notch 22d is located. With this arrangement of the plates and the holes on the plates, the compressed air circulates within the expansion chamber 20. The moisture which drops out of the compressed air settles to the bottom of the expansion chamber 20 as discussed above.

Figure 5:
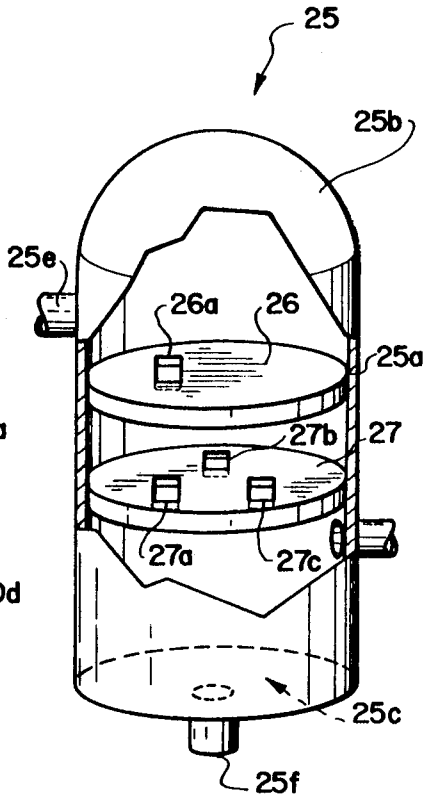
FIG. 5 is a second embodiment of the present invention.

A second embodiment of the present invention as illustrated in FIG. 5, shows an expansion chamber 25 having a cylindrically shaped wall 25a with a top semi-spherical hollow portion 25b and a bottom flat circular solid portion 25c. The expansion chamber 25 has an air inlet 25d and an air outlet 25e, which are connectable to black pipe arrangements as discussed in the two environments described above. The expansion chamber 25 also has a drain outlet 25f for placing thereon either the manual drain valve or the automatic drain valve as discussed above.

Within the expansion chamber 25 are a top circular baffle plate 26 and a bottom circular baffle plate 27. The top circular baffle plate 26 is located below the air outlet 25*e* and the bottom circular baffle plate 27 is located above the air inlet 25*d*. A square cutout 26*a* is located on the top circular baffle plate 26 near its outer perimeter. Square cutouts 27*a*, 27*b*, and 27*c* are located on the bottom circular baffle plate 27 equally spaced from each other. The square cutout 26*a* is not located directly above any of the square cutouts on the bottom circular baffle plate 27.

Figure 6:
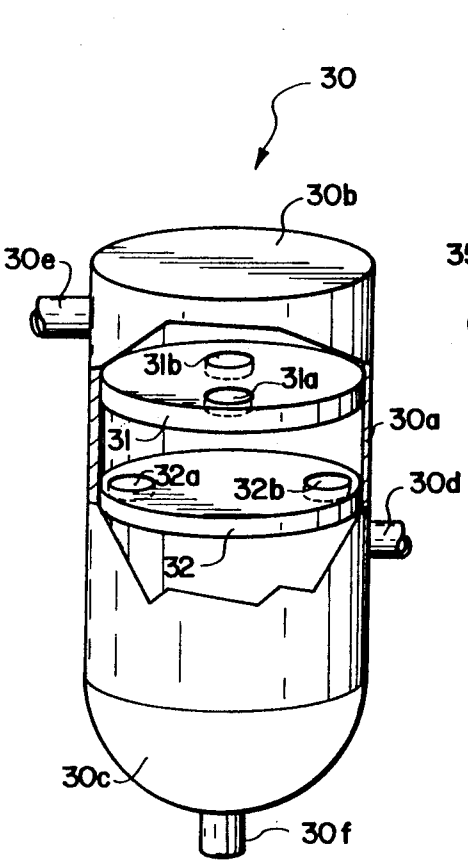
FIG. 6 is a third embodiment of the present invention.

A third embodiment of the present invention is shown in FIG. 6. As illustrated therein, an expansion chamber 30 has a cylindrically shaped wall 30*a* with a top flat circular solid portion 30*b* and a bottom semi-spherical hollow portion 30*c*. The expansion chamber 30 has an air inlet 30*d* and an air outlet 30*e*, as well as a drain outlet 30*f* for connecting one of the two drain valves discussed above.

Within the expansion chamber 30 are a top circular baffle plate 31 and a bottom circular baffle plate 32. The top circular baffle plate is located below the air outlet 30*e* and the bottom circular baffle plate is located above the air inlet 30*d*. On the top circular baffle plate 31 is a circular cutout 31*a* located near the outer perimeter. In an opposite region of the top circular baffle plate 31 on which the circular cutout 31*a* is located is another circular cutout 31*b*. A circular cutout 32*a* is located on the bottom circular baffle plate 32 near the outer perimeter in a region directly below a region of the top circular baffle plate 31 which is a quarter revolution in a clockwise direction from the region in which the circular cutout 31*a* is located. A circular cutout 32*b* is located in a region directly opposite the region the circular cutout 32*a* is located.

Figure 7:
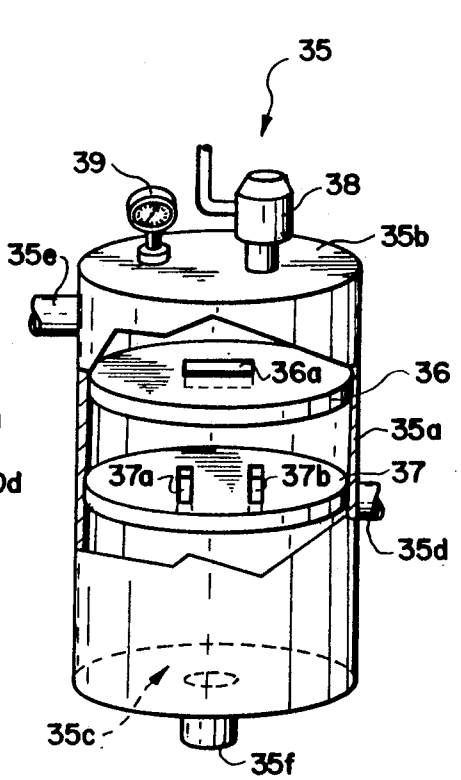
FIG. 7 is a fourth embodiment of the present invention.

A fourth embodiment is illustrated in FIG. 7. The expansion chamber 35 has a cylindrically shaped wall 35*a* with a top flat circular solid portion 35*b* as well as a bottom circular solid portion 35*c*. The expansion chamber 35 also has an air inlet 35*d*, an air outlet 35*e*, and a drain outlet 35*f*. Located on top of the expansion chamber on the top circular flat portion 35*b* are a release valve 38 as well as a pressure gauge 39, both of which operate in a conventional manner.

Within the expansion chamber 35 are located a top circular baffle plate 36 and a bottom baffle plate 37. On the top circular baffle plate 36 is a slit 36*a* located in a first half region of the top circular baffle plate 36 distinguished from a second half region by a diameter of the top circular baffle plate 36 running in a direction from a region at the perimeter thereon to another opposite region of the perimeter. On the bottom circular baffle plate 37 are slits 37*a* and 37*b*, in which the slit 37*a* is located in a first half region of the bottom circular baffle plate 37 distinguished from a second half region by a diameter running in a direction opposite to the diameter of the top circular baffle plate 36 from a region of the perimeter of the bottom circular baffle plate 37 to another opposite region thereon. The slit 37*b* is located in the second half of the region on the bottom circular baffle plate 37.

Figures 8, 9, 10, 11:
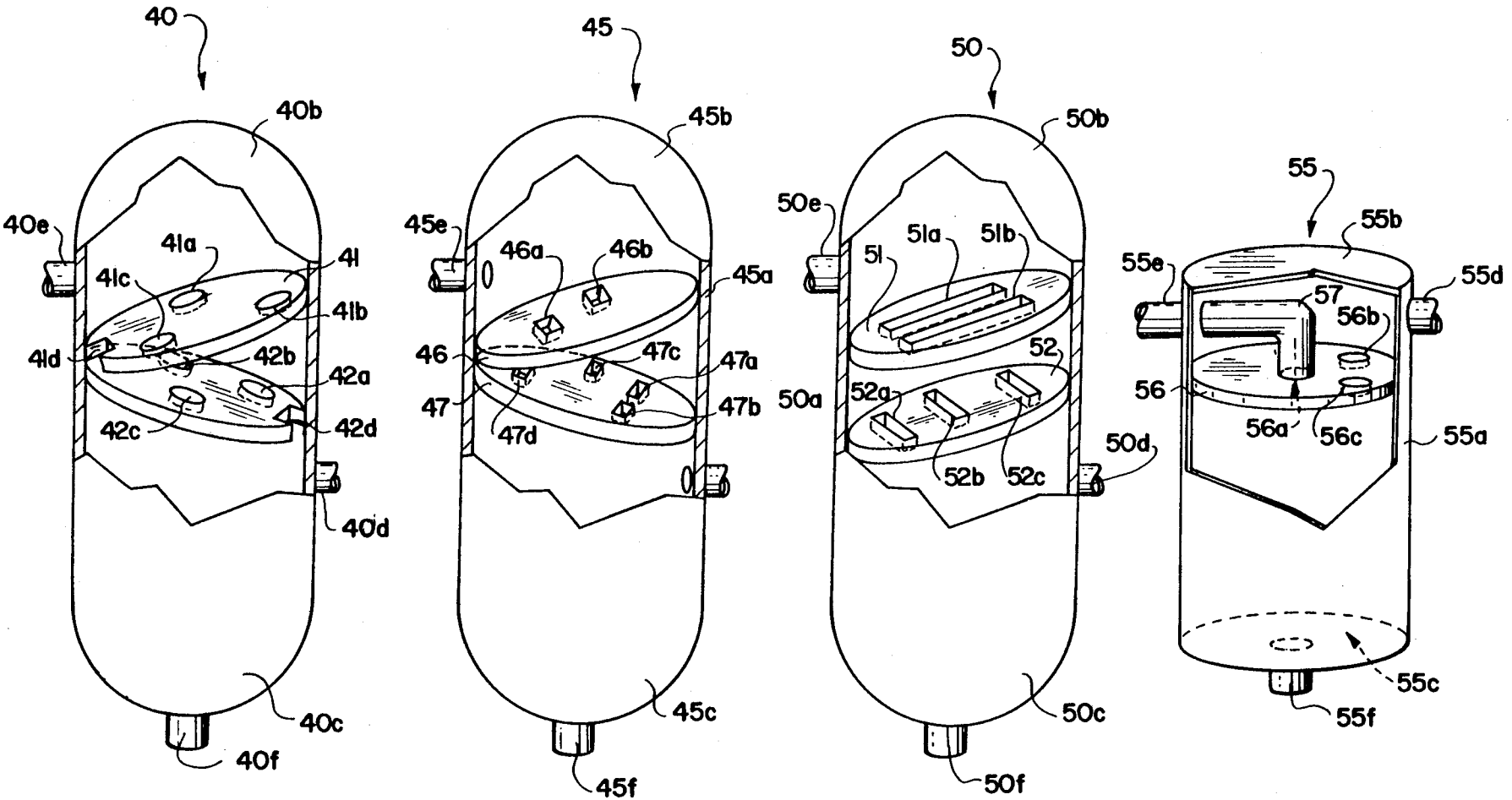
FIG. 8 is a fifth embodiment of the present invention.
FIG. 9 is a sixth embodiment of the present invention.
FIG. 10 is a seventh embodiment of the present invention.
FIG. 11 is an eighth embodiment of the present invention.

A fifth embodiment of the present invention is illustrated in FIG. 8 in which an expansion chamber 40 has a cylindrically shaped wall 40*a* with a top semi-spherical hollow portion 40*b* and a bottom semi-spherical solid portion 40*c*. The expansion chamber 40 also has an air inlet 40*d* connected to a first side of the cylindrically shaped wall 40*a*, where the first side of the wall extends from the top down to the bottom of the cylindrically shaped wall 40*a*. An air outlet 40*e* is connected to a second side of the cylindrically shaped wall 40*a*, where the second side of the wall extends from the top down to the bottom of the cylindrically shaped wall 40*a*. A drain outlet 40*f* is connected to the semi-spherical hollow portion 40*c*.

Within the expansion chamber 40 are located two baffle plates, a top inclined baffle plate 41 and a bottom inclined baffle plate 42. The top inclined baffle plate 41 has a top end in contact with the first side of the cylindrically shaped wall 40*a* and one bottom end in contact with the second side of the cylindrically shaped wall 40*a* below the air outlet 40*e*. The bottom inclined baffle plate 42 has a top end in contact with the bottom end of the top inclined baffle plate 41. The bottom end of the bottom inclined baffle plate is in contact with the first side of the cylindrically shaped wall 40*a* above said air inlet. The top inclined baffle plate has three circular cutouts 41*a*, 41*b*, and 41*c*. These circular cutouts are all equally spaced from one another. The bottom inclined baffle plate 42 has three circular cutouts 42*a*, 42*b*, and 42*c*, also equally spaced from one another, such that not one of the circular cutouts 42*a*, 42*b*, and 42*c* are located directly below any of the circular cutouts 41*a*, 41*b*, and 41*c*. Also, on the top inclined baffle plate 41 there is a square notch 41*d* located at its bottom end and on the bottom inclined baffle plate 42 there is a square notch 42*d* located at its bottom end.

A sixth embodiment of the present invention is illustrated in FIG. 9 in which an expansion chamber 45 has a cylindrically shaped wall 45*a* with a top semi-spherical solid portion 45*b* and a bottom semi-spherical hollow portion 45*c*. The expansion chamber 45 also has an air inlet 45*d* connected to a first side of the cylindrically shaped wall 45*a* and an air outlet 45*e* connected to a second side of the cylindrically shaped wall 45*a*, where both the first side and the second side extend from the top portion down to the bottom of the cylindrically shaped wall 45*a*. The expansion chamber 45 also has a drain outlet 45*f* connected to the bottom semi-spherical hollow portion 45*c*.

Within the expansion chamber 45 there is a top inclined baffle plate 46 and a bottom inclined baffle plate 47. Located on the top inclined baffle plate 46 are two square cutouts 46*a* and 46*b*. Located on the bottom baffle plate 47 are four square cutouts 47*a*, 47*b*, 47*c*, and 47*d*. Not one of the square cutouts 47*a*, 47*b*, 47*c*, and 47*d* are located directly below any of the square cutouts 46*a* and 46*b*.

A seventh embodiment of the present invention is illustrated in FIG. 10. An expansion chamber 50 has a cylindrically shaped wall 50*a* with a top semi-spherical hollow portion 50*b* and a bottom semi-spherical hollow portion 50*c*. The expansion chamber 50 also has an air inlet 50*d* located on a first side of the cylindrically shaped wall 50*a*, where the first side of the wall extends from the top of the wall down to the bottom of the wall, and an air outlet 50*e* located on a second side of the cylindrically shaped wall 50*a*, where the second side of the wall also extends from the top of the wall down to the bottom of the wall. The expansion chamber 50 also has a drain outlet 50*f* located on the bottom semi-spherical hollow portion 50*c*.

Within the expansion chamber 50 there is located a top inclined baffle plate 51 and a bottom inclined baffle plate 52. The top inclined baffle plate 51 has a top end located on the first side of the cylindrically shaped wall and a bottom end located on the second side of the cylindrically shaped wall 50*a* below the air outlet 50*e*. The bottom inclined baffle plate 52 has a top end located on the first side of the cylindrically shaped wall above the air inlet 50*d* and a bottom end located on the second side of the cylindrically shaped wall 50*a*. A slit 51*a* is located on the top inclined baffle plate 51 in a first half region distinguished from a second half region thereof by a diameter of the top inclined baffle plate running in a direction from one perimeter region of the baffle plate to another perimeter region of the baffle plate opposite the other perimeter region. A second slit 51*b* is located in the second half region of the top inclined baffle plate 51. A slit 52*a* is located on the bottom inclined baffle plate 52 in a first half region distinguished from a second half region by a diameter of the baffle plate running in a second direction perpendicular to the first direction from one perimeter region to another perimeter region of the bottom inclined baffle plate 52 opposite the other perimeter region. A slit 52*b* is located on the bottom inclined baffle plate 52 with its lengthwise direction located along the diameter of the baffle plate. Another slit 52*c* is located on the bottom inclined baffle plate 52 in the second half region thereof. Note that the lengthwise direction of each of the slits 51*a*, 51*b*, 52*a*, 52*b*, and 52*c* are parallel with the direction of the diameter dividing the baffle plate that particular slit is located on and perpendicular to the direction of the diameter dividing the other baffle plate.

In FIG. 11 there is illustrated an eighth embodiment in which an expansion chamber 51 has a cylindrically shaped wall 55*a* with an air inlet 55*d* located on a first side of the cylindrically shaped wall 55*a* as well as an air outlet 55*e* located on the second side of the cylindrically shaped wall 55*a*. At the top of the cylindrically shaped wall 55*a* is a flat circular solid portion 55*b* while at the bottom of the cylindrically shaped wall 55*a* is a flat circular solid portion 55*c* with a drain outlet 55*f* attached thereto.

Within the expansion chamber 55 is a circular baffle plate 56 located below the air inlet 55*d* and the air outlet 55*e*. The circular baffle plate 56 has circular cutout 56*a* located in the center of the baffle plate. Two other circular cutouts 56*b* and 56*c* are located in separate halves of the circular baffle plate 56, wherein the halves are divided by a diameter of the circular baffle plate running from one perimeter region thereof to another perimeter region thereof opposite the other perimeter region. Each of the circular cutouts 56*a*, 56*b*, and 56*c* are equally spaced from the other two circular cutouts. A pipe arrangement 57 is located within the expansion chamber 55 and has one end connected to the air outlet 55*e* and another end placed through the circular cutout 56*a* so as to direct any air below the circular baffle plate 56 to the air outlet 55*e*.

Figure 12:
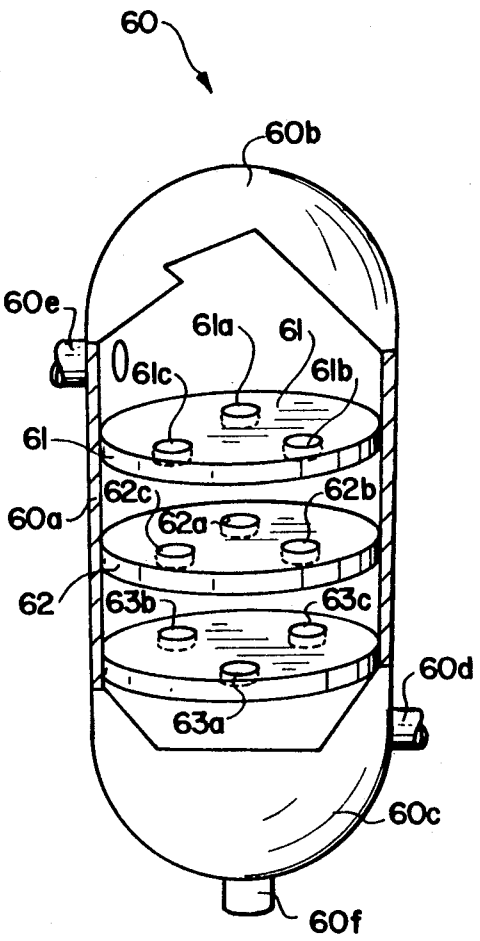
FIG. 12 is a ninth embodiment of the present invention.

In FIG. 12, a ninth embodiment of the present invention is illustrated. An expansion chamber 60 has a cylindrically shaped wall 60*a* with a top semi-spherical hollow portion 60*b* and a bottom semi-spherical hollow portion 60*c* attached thereto. The expansion chamber 60 also has an air inlet 60*d* located on the first side of the cylindrically shaped wall, an air outlet 60*e* located on the second side of the cylindrically shaped wall, and a drain outlet 60*f* located on the bottom semi-spherical hollow portion 60*c*.

Within the expansion chamber 60 there is a top circular baffle plate 61 located below the air outlet 60*e*, with a middle circular baffle plate 62 located below the top circular baffle plate 61 and a bottom circular baffle plate 63 located below the middle circular baffle plate 62. The bottom circular baffle plate 63 is located above the air inlet 60*d* so that all three baffle plates are located between the air inlet 60*d* and the air outlet 60*e*. The top circular baffle plate 61 has three circular cutouts 61*a*, 61*b*, and 61*c* located thereon, each circular cutout being equally spaced from the other two circular cutouts. The middle circular baffle plate 62 has three circular cutouts 62*a*, 62*b*, and 62*c* located thereon, each of which are equally spaced from the other two circular cutouts located on the middle circular baffle plate 62. The bottom circular baffle plate 63 has three circular cutouts 63*a*, 63*b*, and 63*c* located thereon, each circular cutout being equally spaced from the other two circular cutouts located on the bottom circular baffle plate 63. The circular cutouts 61*a*, 61*b*, and 61*c* are located directly below the circular cutouts 62*a*, 62*b*, and 62*c*, respectively, while not one of the circular cutouts 63*a*, 63*b*, and 63*c* are located directly above the circular cutouts 62*a*, 62*b*, and 62*c*.

Figure 13:
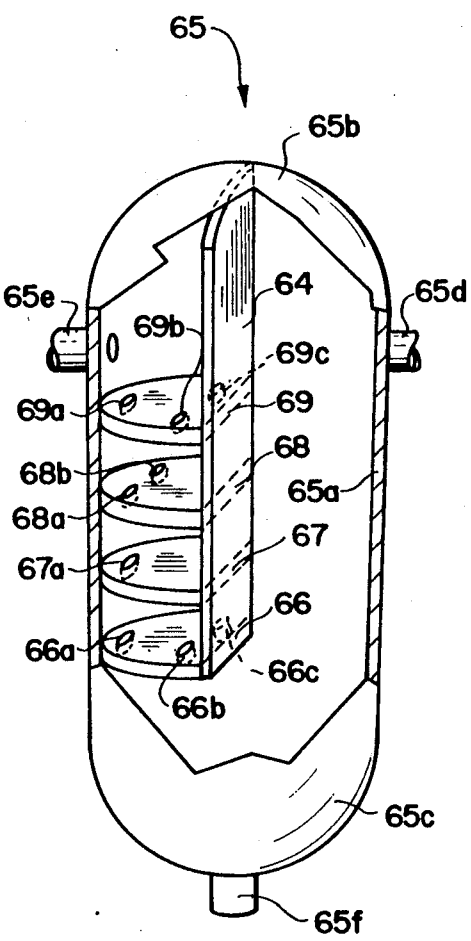
FIG. 13 is a tenth embodiment of the present invention.

FIG. 13 illustrates a tenth embodiment of the present invention wherein an expansion chamber 65 has a cylindrically shaped wall 65*a* with a top semi-spherical hollow portion 65*b* and a bottom semi-spherical hollow portion 65*c*. A drain outlet 65*f* is attached to the bottom semi-spherical hollow portion 65*c*. An air inlet 65*d* is attached to a first side of the cylindrically shaped wall 65*a* while an air outlet 65*e* is attached to a second side of the cylindrically shaped wall 65*a* opposite the first side.

Within the expansion chamber 65, a partitioning wall 64 is positioned halfway between the first and second side of the cylindrically shaped wall 65*a*. The partitioning wall 64 extends from the top semi-spherical hollow portion 65*b* down below the air outlet 65*e* by a predetermined distance. One side of the partitioning wall 64 extends from the top of the concave portion of the top semi-spherical hollow portion 65*b* to the bottom of the top semi-spherical hollow portion 65*b* in contact with a third side of the cylindrically shaped wall 65*a*. The one side of the partitioning wall 64 then proceeds from that point of the third side of the cylindrically shaped wall 65*a* at the top of the cylindrically shaped wall 65*a* to a point along the third side of the cylindrically shaped wall 65*a* which is the predetermined distance below the air outlet 65*e*. The other side of the partitioning wall 64 (not shown in FIG. 13) extends from the top of the concave portion of the top semi-spherical hollow portion 65*b* to the bottom of the top semi-spherical hollow portion 65*b* in contact with a fourth side of the cylindrically shaped wall 65*a*. The fourth side of the cylindrically shaped wall 65*a* is opposite the third side of the cylindrically shaped wall 65*a*. The other side of the partitioning wall 64 then proceeds from the top of the cylindrically shaped wall 65*a* along the fourth side thereof to a point the predetermined distance below the air outlet 65*e*.

A bottom most baffle plate 66 is located a predetermined distance below the air outlet between the second side of the cylindrically shaped wall and the partitioning wall 64. Directly above the bottom most baffle plate 66 is a bottom middle baffle plate 67, above that is a top middle baffle plate 68, and above that is a top most baffle plate 69. The perimeters of each of the baffle plates 66, 67, 68, and 69 extend along the partitioning wall 64 from its one side to its other side and along the cylindrically shaped wall 65*a* from the third side of the cylindrically shaped to the second side of the cylindrically shaped wall and then to the fourth side of the cylindrically shaped wall.

Circular cutouts 66*a*, 66*b*, and 66*c* are located on the bottom most baffle plate 66. The circular cutout 66*a* is located in the vicinity of the outer perimeter of the bottom most baffle plate 66 near the second side of the cylindrically shaped wall 65*a*. The circular cutout 66*b* is located in the vicinity of the outer perimeter of the bottom most baffle plate 66 near the third side of the cylindrically shaped wall 65*a*. The circular cutout 66*c* is located in the vicinity of the outer perimeter of the bottom most baffle plate 66 near the fourth side of the cylindrically shaped wall 65*a*. Circular cutout 67*a* is located on the bottom middle baffle plate 67 in the vicinity of the outer perimeter of the baffle plate 67 near the second side of the cylindrically shaped wall 65. Circular cutouts 68*a* and 68*b* are both located on the top middle baffle plate 68, where the circular cutout 68*a* is located in the vicinity of the outer perimeter of the middle baffle plate 68 near a side of the cylindrically shaped wall 65*a* halfway between the second side and the third side of the cylindrically shaped wall 65*a*, and where the circular cutout 68*b* is located in the vicinity of the outer perimeter of the middle baffle plate 68 near a side of the cylindrically shaped wall 65*a* halfway between the fourth side of the cylindrically shaped wall 65*a* and the second side of the cylindrically shaped wall 65*a*. Circular cutouts 69*a*, 69*b*, and 69*c* are all located on the top most baffle plate 69. Circular cutout 69*a* is located near the vicinity of the outer perimeter of the top most baffle plate 69 near the second side of the cylindrical side wall 65*a*. Circular cutout 69*b* is located near the vicinity of the outer perimeter of the top most baffle plate 69 near the third side of the cylindrically shaped wall 65*a*. Circular cutout 69*c* is located near the vicinity of the outer perimeter of the top most baffle plate 69 near the fourth side of the cylindrically shaped wall 65*a*. Note that the circular cutout 67*a* is larger than any of the other circular cutouts of the tenth embodiment.

Figure 14:
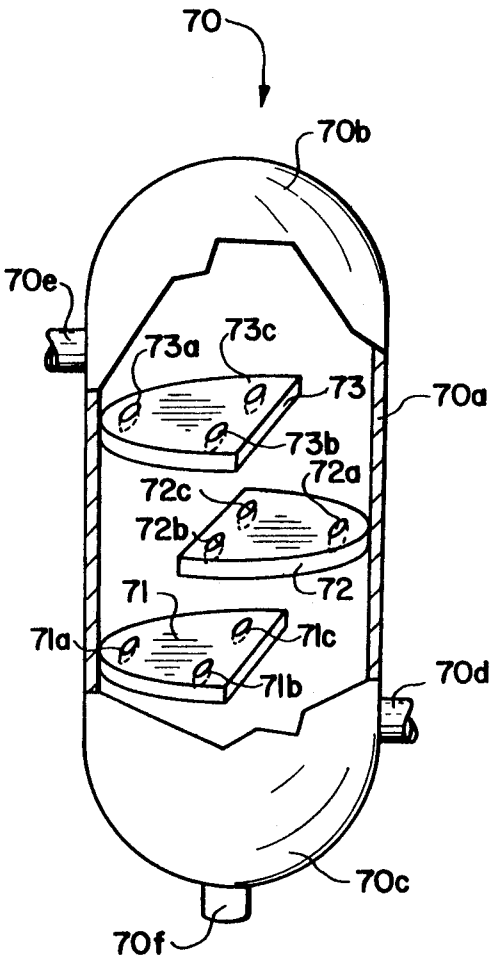
FIG. 14 is an eleventh embodiment of the present invention.

An eleventh embodiment of the invention is shown in FIG. 14. An expansion chamber 70 has top semi-spherical portion 70*b* and bottom semi-spherical portion 70*c*, which cap a cylinder 70*a*. Air inlet 70*d*, air outlet 70*e* and drain 70*f* are located as shown. Offset, semicircular baffle plates 71, 72 and 73 include circular cutouts 71*a*, 71*b*, 71*c*, and 72*a*, 72*b*, 72*c*, and 73*a*, 73*b*, 73*c*, respectively, and extend beyond a semicircular shape so that cutouts 71*b*, 72*b* and 73*b* are arranged on one common line, and cutouts 71*c*, 72*c* and 73*c* are arranged on another common line.

Figure 16:
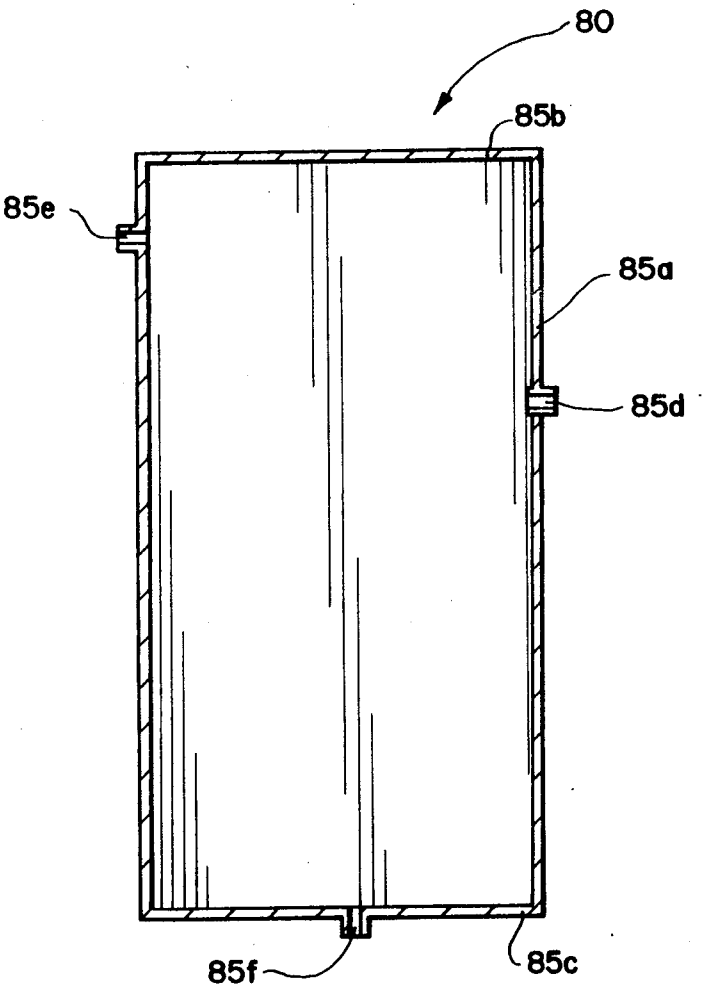
Figure 15:
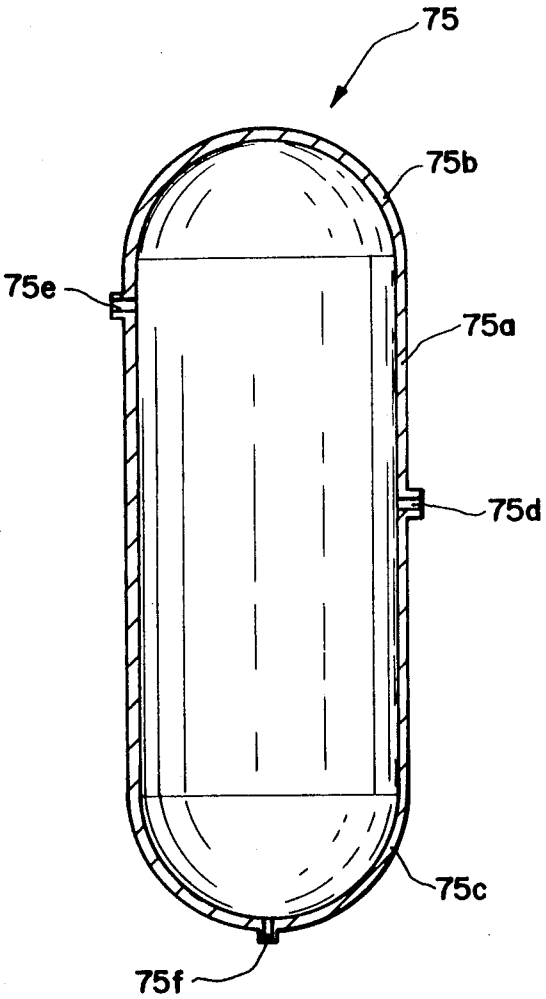

A twelfth embodiment of the invention is shown in FIG. 15, including expansion chamber 75 made up of cylinder 75*a*, capped with semi-spherical top 75*b* and bottom 75*c*, air inlet 75*d*, air outlet 75*e*, and drain outlet 75*f*. The thirteenth embodiment, chamber 80, illustrated in FIG. 16, is similar, also having an uninterrupted interior, and includes cylinder 85*a*, capped by flat, circular plates 85*b* and 85*c*, an air inlet 85*d*, air outlet 85*e*, and bottom, drain outlet 85*f*.

It is to be understood that the present invention is not limited to the embodiments described above, but encompasses any and all embodiments within the scope of the following claims.

I claim:

1. A condensate removal system for removing condensate from an air compressor system having at least one compression chamber stage for discharging compressed air into an air holding tank, said condensate removal system comprising:

an expansion chamber having a cylindrically shaped wall and a top portion at the top end of said cylindrically shaped wall as well as a bottom portion at the bottom end of said cylindrically shaped wall;

an air inlet connected to a first side of said cylindrically shaped wall for allowing compressed air to enter said expansion chamber along with any moisture suspended in the air;

an air outlet connected to a second side of said cylindrically shaped wall opposite said first side for discharging from said expansion chamber said compressed air circulating therein;

a drain outlet located on said bottom portion;

a first black pipe arrangement connected at one end to said air inlet for directing compressed air entering a second end of said first black pipe arrangement to said air inlet; and a second black pipe arrangement connected at one end to said air outlet for directing air exiting said air outlet to a second end of said second black pipe arrangement;

said expansion chamber comprising:

a top circular baffle plate located therein whose outer perimeter is in contact with said cylindrically shaped wall, wherein said top circular baffle plate is located below said air outlet a first predetermined distance;

a bottom circular baffle plate located therein whose outer perimeter is in contact with said cylindrically shaped wall, wherein said bottom circular baffle plate is located below said air outlet a second predetermined distance, wherein said second predetermined distance is greater than said first predetermined distance, and wherein said air inlet is located below said air outlet by a third predetermined distance greater than said second predetermined distance;

a first, second, and third circular cutout each located on said top circular baffle plate, wherein each of said first, second, and third circular cutouts are equally spaced from the other two circular cutouts located on said top circular baffle plate; and a fourth, fifth, and sixth circular cutout located on the bottom circular baffle plate, wherein each of said fourth, fifth and sixth circular cutouts are equally spaced from the other two circular cutouts located on said bottom circular baffle plate, wherein not one of said fourth, fifth, and sixth circular cutouts are located directly below any of said first, second, and third circular cutouts, and wherein said top portion and said bottom portion both comprise semi-spherical hollow portions.

2. A condensate removal system as claimed in claim 1, wherein said drain air outlet is a manually turned drain valve.

3. A condensate removal system as claimed in claim 1, wherein said drain air outlet is an automatic drain system having an electric solenoid valve.

4. A condensate removal system as claimed in claim 1, wherein said second end of said first black pipe arrangement is connected to a discharge end of a particular compression chamber stage, and wherein said second end of said second black pipe arrangement is connected to an inlet to another compression chamber stage subsequent to said particular compression chamber stage.

5. A condensate removal system as claimed in claim 1, wherein said second end of said first black pipe arrangement is connected to a discharge end of a particular compression chamber stage, and wherein said second end of said second black pipe arrangement is connected to an inlet of said air holding tank.

* * * * *